US006684978B1

(12) United States Patent
Gupta

(10) Patent No.: US 6,684,978 B1
(45) Date of Patent: Feb. 3, 2004

(54) BUILDING EVACUATION SYSTEM

(76) Inventor: Vivek Gupta, 989 Limestone Dr., Kingston, ON (CA), K7P 2R8

( * ) Notice: Subject to any disclaimer, the term of this patent is extended or adjusted under 35 U.S.C. 154(b) by 0 days.

(21) Appl. No.: 10/321,702

(22) Filed: Dec. 18, 2002

(51) Int. Cl.[7] ..... A62B 1/00
(52) U.S. Cl. ..... 182/48; 182/36
(58) Field of Search ..... 182/48, 11, 82, 182/36, 10, 12; 472/116, 117

(56) References Cited

U.S. PATENT DOCUMENTS

| | | | | | |
|---|---|---|---|---|---|
| 636,605 | A | * | 11/1899 | Wilson | 182/10 |
| 4,037,685 | A | | 7/1977 | Talucci | |
| 4,207,965 | A | * | 6/1980 | Chiang-Cheng et al. | 182/13 |
| 4,372,423 | A | | 2/1983 | Pelley | |
| 4,396,094 | A | * | 8/1983 | Charlton et al. | 187/245 |
| 4,398,621 | A | | 8/1983 | Baker | |
| 4,520,900 | A | | 6/1985 | Orgeron | |
| 4,531,611 | A | | 7/1985 | Curiel | |
| 4,538,704 | A | | 9/1985 | Forrest | |
| 4,580,659 | A | | 4/1986 | Baker | |
| 4,606,431 | A | | 8/1986 | Ruder | |
| 4,997,060 | A | * | 3/1991 | Sassak | 182/48 |
| 5,115,885 | A | | 5/1992 | Chouest | |
| 5,135,076 | A | | 8/1992 | Su | |
| 5,392,877 | A | | 2/1995 | Shahin | |
| 5,535,848 | A | | 7/1996 | Giuliano | |
| 5,620,058 | A | | 4/1997 | Forrester | |
| 6,098,747 | A | | 8/2000 | Reece | |
| 6,298,970 | B1 | | 10/2001 | Targiroff | |
| 6,598,703 | B1 | * | 7/2003 | Catalan | 182/48 |
| 2003/0116381 | A1 | * | 6/2003 | Gomes Junior | 182/48 |

* cited by examiner

*Primary Examiner*—Alvin Chin-Shue
(74) *Attorney, Agent, or Firm*—Ralph A. Dowell; Dowell & Dowell PC

(57) ABSTRACT

A building evacuation system in which at least one vertical evacuation chute is provided for each floor of a building to be evacuated. A plurality of collapsible buckets are stored on each floor and, after loading, are slid along horizontal rails to the vertical chute where they engage a plurality of vertical guide tracks. The guide tracks are provided with tapered brake pads so as to provide progressively increasing braking force on the falling buckets. A sloping slide is provided adjacent a lower open end of the chute to slidably transfer the bucket and evacuee to the ground.

6 Claims, 5 Drawing Sheets

BUILDING EVACUATION SYSTEM

FIELD OF INVENTION

This invention relates to a building evacuation system and more particularly to a permanently installed slide-and-bucket evacuation system.

BACKGROUND OF INVENTION AND PRIOR ART

Numerous building evacuation systems for high-rise buildings incorporating chutes, slides and the like have been described in the prior art. Attention is directed, for example, to U.S. Pat. Nos. 5,392,877; 4,037,685 and 4,398,621 as typical, but by no means exhaustive, examples. A major concern in all such systems is the provision of an adequate braking system so as to control the rate of descent of the evacuees. Such braking systems are relatively expensive to install and maintain and there is a need for a simple, but effective and relatively inexpensive, system for evacuating high-rise buildings while controlling the rate of descent of the evacuees, which can be easily installed in new buildings or retrofitted in existing buildings.

OBJECT OF INVENTION

An object of the present invention is to provide a simple building evacuation system, incorporating a progressively applied braking system to retard the rate of fall of the evacuee, which is easy to use and which can evacuate large numbers of people very quickly.

BRIEF STATEMENT OF INVENTION

By one aspect of this invention there is provided a building evacuation system comprising:

- at least one open-ended, substantially vertical, evacuation chute for each floor of a building to be evacuated, each said chute having a plurality of parallel spaced apart guide tracks;
- a pair of substantially horizontal parallel rails suspended above each said floor;
- a plurality of collapsible buckets including a plurality of rollers slidable on said horizontal parallel rails, each said bucket being adapted to receive and releasably retain at least one building evacuee;
- means to transfer a loaded said bucket and the rollers thereof from said horizontal rails into slidable engagement with said guide tracks in a selected one of said vertical evacuation chutes;
- tapered brake pad means contained within said guide tracks and arranged so as to progressively retard the rate of fall of said loaded bucket in said evacuation chute;
- slide means adjacent a lower open end of said evacuation chute, arranged so as to receive a loaded bucket exiting said lower end of said evacuation chute and slidably transfer said loaded bucket to ground level.

DETAILED DESCRIPTION OF PREFERRED EMBODIMENTS

Figure 1:
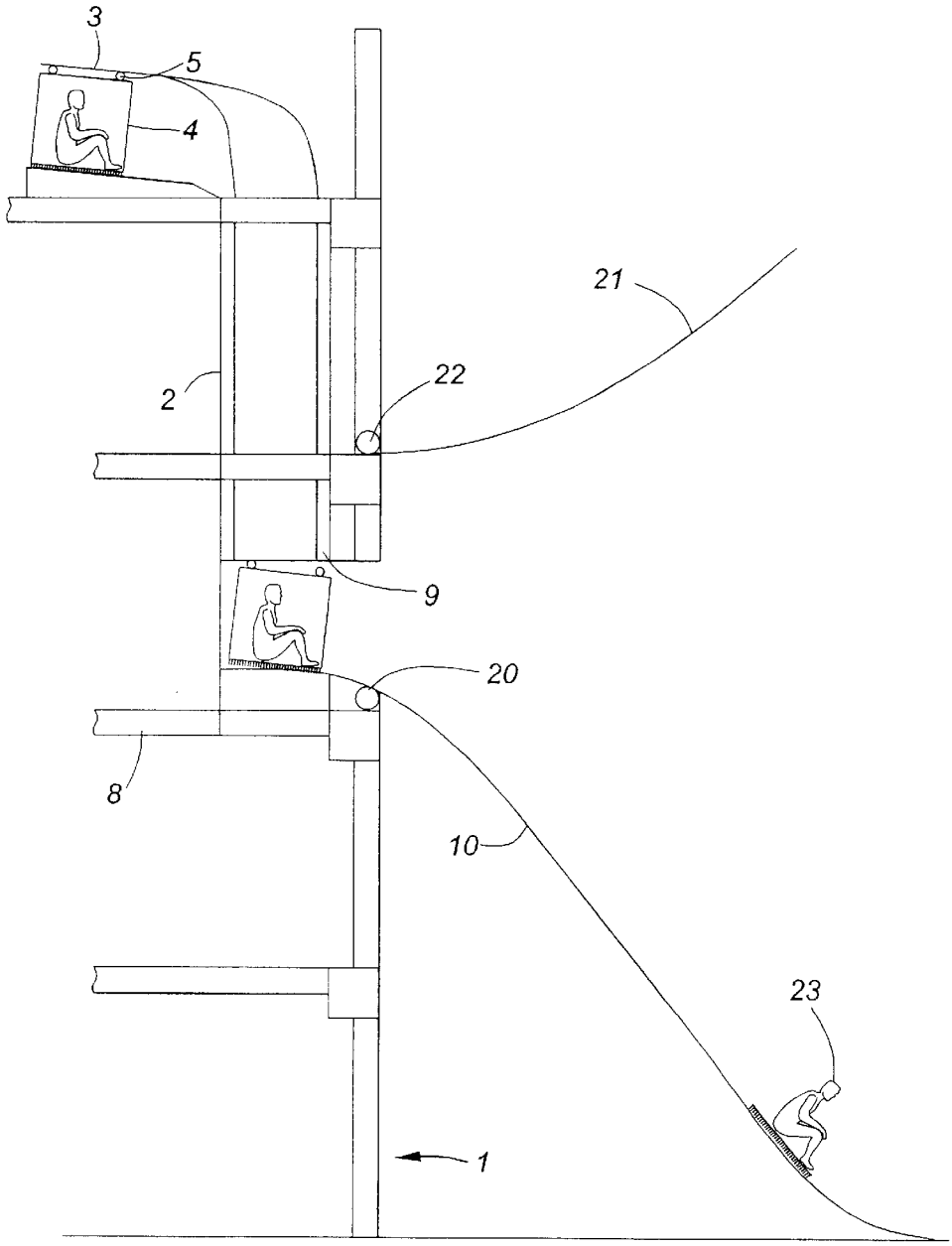
FIG. 1 is a side sectional view of a building incorporating one embodiment of the evacuation system of the present invention.
Figure 2:
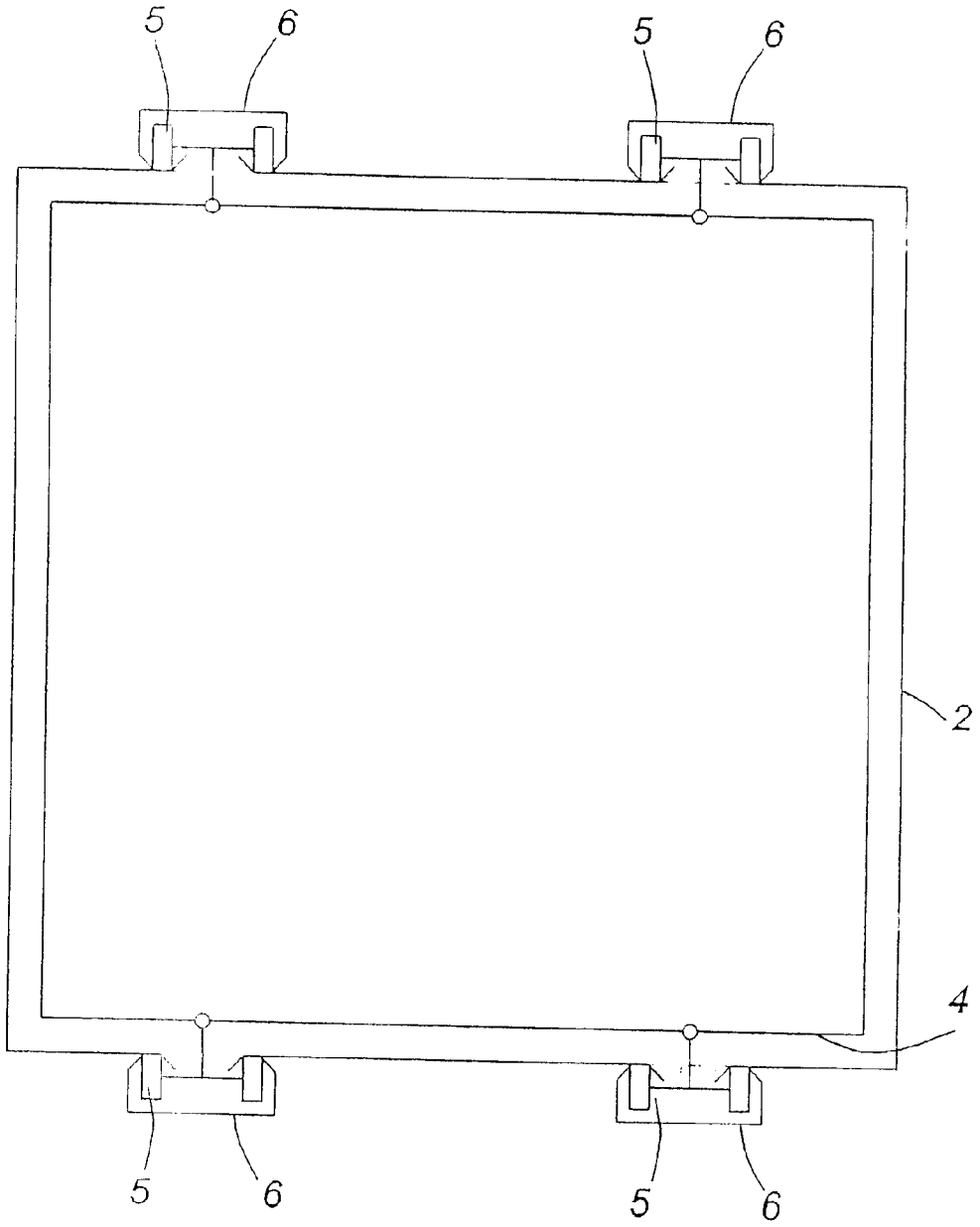
FIG. 2 is a top plan view of an escape chute and bucket of the present invention.
Figure 3:
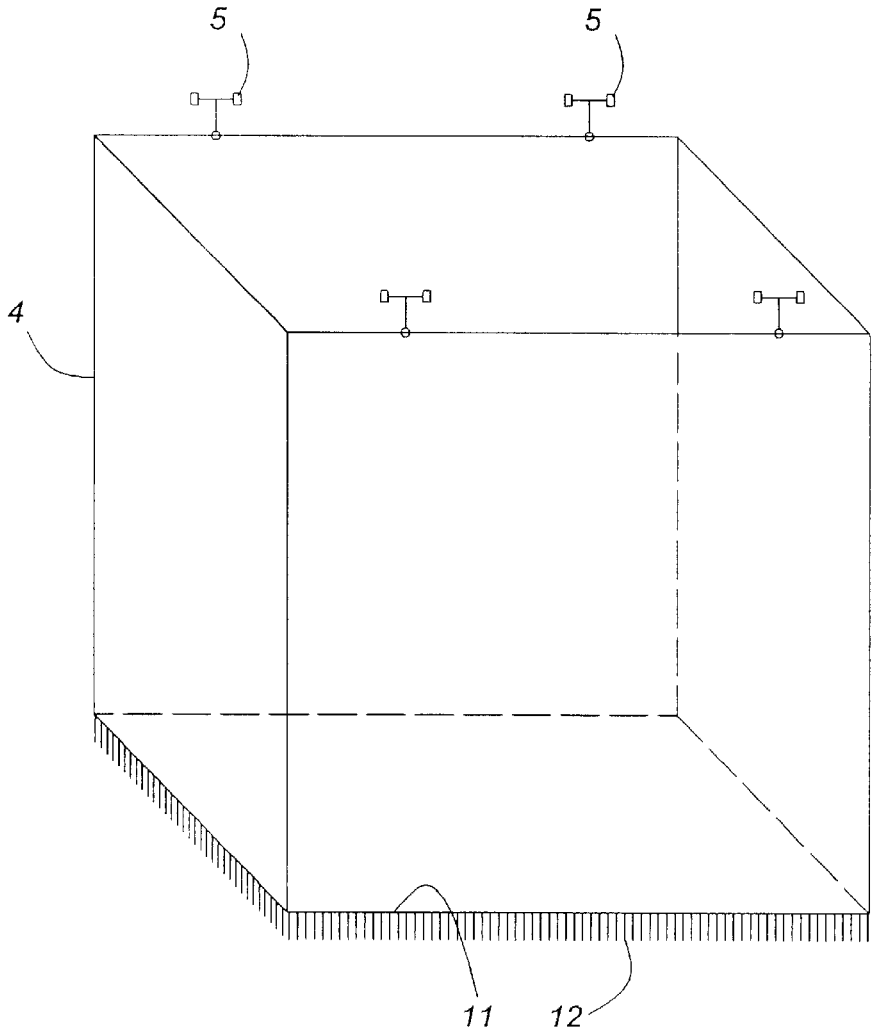
FIG. 3 is an isometric view of the bucket of FIG. 2.
Figure 4:
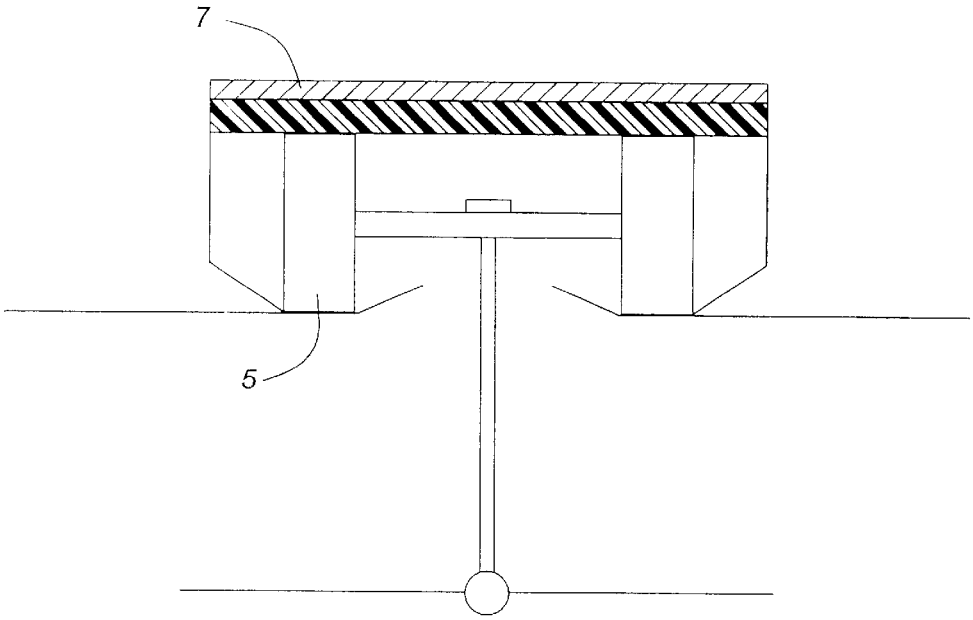
FIG. 4 is an enlarged top plan view of the track shown in FIG. 2.
Figure 5:
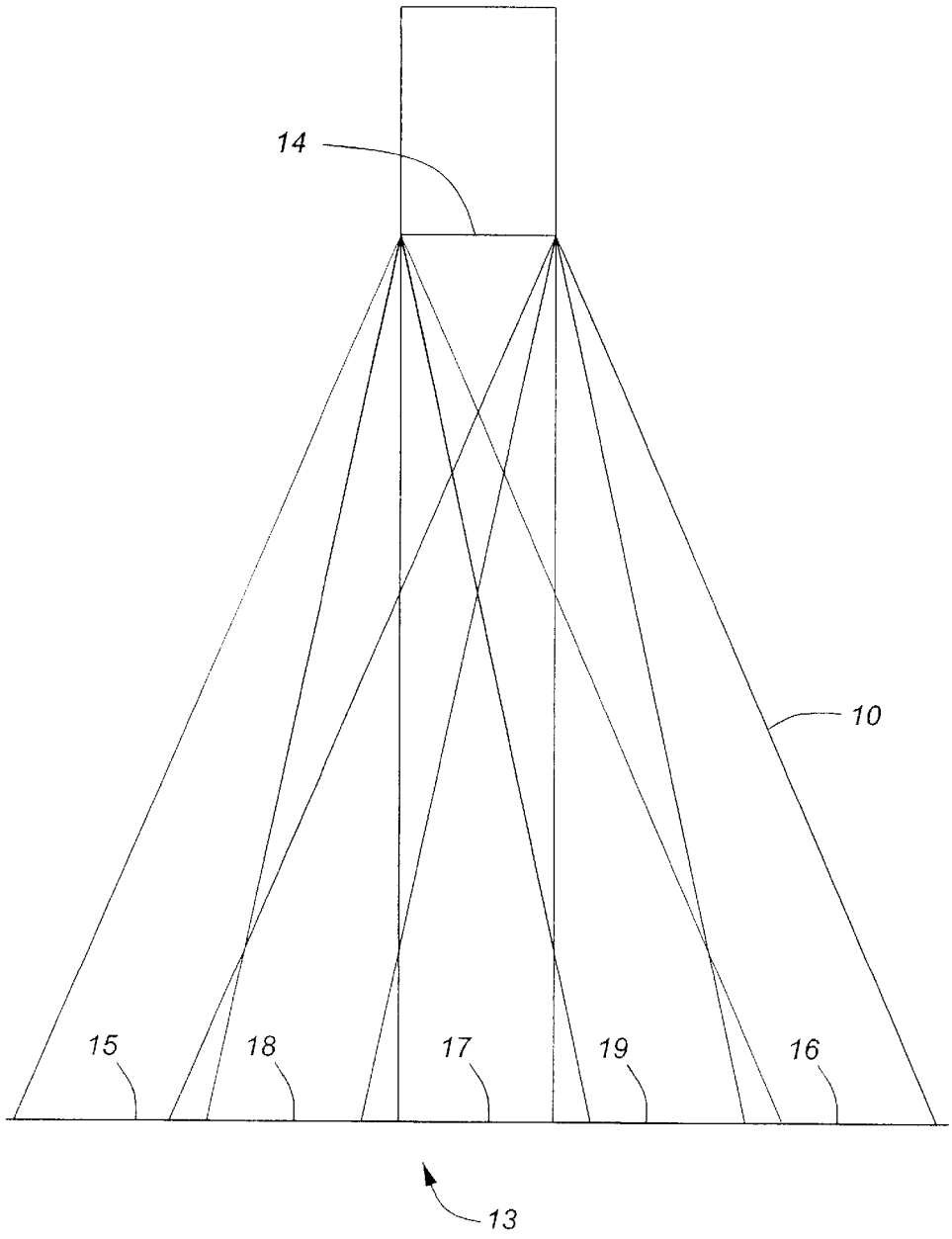
FIG. 5 is a front view of an escape slide from the second floor of a building, equipped with an evacuation chute of the present invention, arranged to prevent pile-ups of evacuees exiting the building.

Turning firstly to FIG. 1, there is shown, in section, a building 1 generally, but not essentially, having 25 or more floors. Each floor is provided with at least one, and preferably with at least two, separate substantially vertical escape chutes 2, internally or externally of the outside wall of the building. The chute may also be installed on an inside wall of the building. The two chutes are preferably on opposite sides of the building in case fire or other emergency blocks access to one or the other of the chutes. Each chute may be insulated and inspection windows may be provided at intervals along the length thereof. Each floor is provided a pair of substantially horizontal parallel rails 3, adjacent each of the vertical escape chutes and connecting therewith, from which a plurality of collapsible buckets 4, generally fabricated from a tough, fire resistant and low abrasion, fabric material such as nylon or canvas, may be suspended on four rollers 5. When collapsed about a vertical axis, the buckets take up very little space and can be compressed into a small storage area. In the event of a building evacuation emergency, the buckets 4 are pulled from storage onto the rails 3 and at a designated loading station one evacuee, or more if children or persons needing assistance are to be evacuated, is loaded into each bucket which is then slid along rails 3 to vertical chute 2. When in position over the chute 2, the rollers 5 engage with the four vertical tracks 6, as shown in FIG. 2, and disengage from rails 3. The bucket 4 is then clear to fall vertically, under gravity, down chute 2. The rate of fall is controlled by the provision of a brake pad 7 (FIG. 4), generally made of conventional automotive type friction brake pad material, along the entire length of the vertical chute 2. The thickness of pad 7 increases linearly along the length so as to provide a progressively increasing braking force on the rollers 5, so that when the bucket reaches the second floor 8, it drops gently clear of the open end 9 of the chute 2, onto a sloping slide 10. Upon release from the chute 2, at the bottom 9 thereof, the vertical walls of the bucket 4 collapse leaving the evacuee 23 sitting on the floor 11 thereof, the underside of which is preferably covered with a low friction material 12, such as a low pile carpeting, so as to provide a smooth gliding movement on slide 10. Slide 10 is normally stored within the building 1 at a lower floor, such as the second floor as seen in FIG. 1, and is deployed either manually or automatically when required to evacuate the buckets 4. Preferably, but not essentially, slide 10 is much wider at the lower end 13 thereof than the top end 14 so as to facilitate egress of a plurality of buckets 4 and evacuees 23 in rapid succession. The first evacuee can be guided to the left side 15 of the slide and the second evacuee to the right side 16. The third is directed to the centre 17, and the fourth and fifth to the left 18 and right 19 thereof respectively. The entire sequence can be repeated as often as necessary, depending upon the number of evacuees on the floor being evacuated. In a preferred embodiment, slide 10 is provided with a spring-loaded roller 20 which can be used to roll up the slide 10 when not in use, and from which the slide 10 can be deployed. A canopy 21 may also be provided to cover the slide egress from the building 1.

Canopy 21 may be stored on, and deployed from, a roller 22 either manually or automatically.

I Claim:

1. A building evacuation system comprising:

at least one open-ended, substantially vertical, evacuation chute for each floor of a building to be evacuated, each said chute having a plurality of parallel spaced apart guide tracks;

a pair of substantially horizontal parallel rails suspended above each said floor;

said horizontal parallel rails suspending a plurality of collapsible buckets including a plurality of rollers slidable on said horizontal parallel rails, each said bucket being adapted to receive and releasably retain at least one building evacuee;

a loaded said bucket and the rollers thereof being transferred from said horizontal rails into slidable engagement with said guide tracks in a selected one of said vertical evacuation chutes;

tapered brake pad means contained within said guide tracks and engaging said rollers so as to progressively retard the rate of fall of said loaded bucket in said evacuation chute;

slide means adjacent a lower open end of said evacuation chute, arranged so as to receive a loaded bucket exiting said lower end of said evacuation chute and slidably transfer said loaded bucket to ground level.

2. An evacuation system as claimed in claim 1, wherein said buckets are collapsible canvas buckets.

3. An evacuation system as claimed in claim 2 wherein said buckets are provided with a low friction material on an underside thereof.

4. An evacuation system as claimed in claim 3 wherein said low friction material is a carpet.

5. An evacuation system as claimed in claim 1 wherein said slide means is tapered outwardly towards a lower end thereof so as to facilitate a plurality of evacuation in rapid succession.

6. An evacuation system as claimed in claim 1 wherein said brake pad means comprises a friction brake pad means.

* * * * *